US005424504A

United States Patent [19]

Tanaka et al.

[11] Patent Number: 5,424,504

[45] Date of Patent: Jun. 13, 1995

[54] RESISTOR-PROVIDED UHV BREAKER HAVING DELAYING/OPERATING MECHANISM FOR MAKING AND BREAKING MAIN CONTACTS AND RESISTOR CONTACTS

[75] Inventors: Tsutomu Tanaka, Yokohama; Shigeki Nishizumi, Tokyo, both of Japan

[73] Assignee: Kabushiki Kaisha Toshiba, Kawasaki, Japan

[21] Appl. No.: 135,547

[22] Filed: Oct. 14, 1993

[30] Foreign Application Priority Data

Oct. 14, 1992 [JP] Japan ..... 4-276205

[51] Int. Cl.[6] ..... H01H 33/16

[52] U.S. Cl. ..... 218/78; 218/143; 218/84

[58] Field of Search ..... 200/144 AP, 148 R, 148 H

[56] References Cited

U.S. PATENT DOCUMENTS

| | | | |
|---|---|---|---|
| 3,482,069 | 12/1969 | Badey et al. | 200/148 |
| 3,763,340 | 10/1973 | Noack | 200/148 D |
| 4,195,211 | 3/1980 | Asian et al. | 200/148 F X |
| 4,419,552 | 12/1983 | Haginomori | 200/144 AP |
| 4,499,350 | 2/1985 | Hidaka | 200/144 AP |

FOREIGN PATENT DOCUMENTS

| | | | |
|---|---|---|---|
| 0001059 | 3/1979 | European Pat. Off. | H01H 33/16 |
| 0050341 | 4/1982 | European Pat. Off. | H01H 33/16 |

*Primary Examiner*—J. R. Scott

*Attorney, Agent, or Firm*—Oblon, Spivak, McClelland, Maier & Neustadt

[57] ABSTRACT

A resistor-provided UHV breaker has a tank sealing an insulating gas therein, a main contact unit located in the tank, a resistor unit connected parallel to the main contact unit, a resistor contact unit located in the tank, a main contact making/breaking unit for making and breaking the main contact unit, and a resistor contact making/breaking unit for making and breaking the resistor contact unit. Further, the breaker has a coupling unit for coupling the main contact making/breaking unit with the resistor contact making/breaking unit. The coupling unit drives the main contact making/breaking unit together with the resistor contact making/breaking unit during closing operation of the main contact unit, and drives the main contact making/breaking unit and the resistor contact making/breaking unit, independently, during breaking operation of the main contact unit.

6 Claims, 5 Drawing Sheets

RESISTOR-PROVIDED UHV BREAKER HAVING DELAYING/OPERATING MECHANISM FOR MAKING AND BREAKING MAIN CONTACTS AND RESISTOR CONTACTS

BACKGROUND OF THE INVENTION

1. Field of the Invention

The present invention relates to a resistor-provided breaker, wherein resistor contacts for allowing making and breaking to be achieved through resistors are connected parallel to main contacts for allowing making and breaking to be achieved through no resistor, and more particularly to a resistor-provided UHV (Ultra High Voltage) breaker applicable to a UHV electric plant such as a substation in a million-volt power supply system line.

2. Description of the Related Art

There is a resistor-provided breaker in which resistor contacts for allowing making and breaking to be achieved through a resistor are connected parallel to main contacts for allowing making and breaking to be achieved through no resistor. In this breaker, first; power transmission lines are connected to each other through a resistor, and thereafter the resistor is disconnected from the circuit, thus completing closure of the circuit. This can minimize, even at the time of making an unloaded 500,000-volt-order line, a very high overvoltage which occurs when a breaker without resistors is used.

Among resistor-provided breakers of this type, an example of a 500,000-volt breaker will be explained with reference to FIG. 1. In a tank 1, sealing an insulation gas therein, two main contacts 2*a* and 2*b* are contained. These contacts 2*a* and 2*b* are connected to resistors 3*a* and 3*b*, respectively. The resistors 3*a* and 3*b* are connected to resistor contacts 4*a* and 4*b*, respectively. An operation mechanism unit 5 is provided under the tank 1, and connected to the main contacts 2*a* and 2*b* and the resistor contacts 4*a* and 4*b* via rotary links 6*a* and 6*b*, provided in the tank 1. The driving force of the operation mechanism unit 5 is transmitted to the main and resistor contacts 2*a*, 2*b*, 4*a*, and 4*b* to make and break them, after the direction, in which the driving force acts, is changed by means of the rotary links 6*a* and 6*b*.

In the above-described 500,000-volt resistor-provided breaker, to make the circuit, the resistor contacts 4*a* and 4*b* are made about 10 msec. before the main contacts 2*a* and 2*b*. This operation minimizes an overvoltage which occurs at the time of making the circuit. After making the resistor contacts 4*a* and 4*b*, the main contacts 2*a* and 2*b* are made. On the other hand, at the time of breaking the circuit, the resistor contacts 4*a* and 4*b* are broke, before the main contacts 2*a* and 2*b*. In other words, in a resistor-provided breaker of this type, the resistor contacts 4*a* and 4*b* are operated before the main contacts 2*a* and 2*b*, at the time of both making and breaking the circuit. Therefore, the operation mechanism unit 5 can be made to have a simple structure using a spring mechanism, etc., and only one mechanism 5 can perform the operation.

Recently, it has been more and more requested that the length of a transmission line be increased, and that voltage supplied through a power transmission system line in order also be to increased in order to increase the transmission efficiency. To meet these requests, a million-volt-order (UHV) transmission system line is now being planned.

A resistor-provided UHV (for example, million volts) breaker has been proposed as a breaker for use in such a UHV transmission system line. This resistor-provided UHV breaker has a structure in which a resistor is connected parallel to a main contact at the time of breaking, so as to reduce the rate of increase in the transient recovery voltage which occurs at the main contact after breaking, and thereby facilitating the breaking operation. This structure can be employed in order to minimize the overvoltage (such as grounding) which occurs after breaking as well as at the time of breaking.

An example of a conventional resistor-provided UHV breaker for performing the above-described making/breaking of a transmission line with the use of a resistor will be explained with reference to FIG. 2. A main contact 2 is located in a tank 1 in which an insulating gas is sealed. A resistor 3 is connected parallel to the main contact 2. At the time of breaking, a resistor contact 7 is connected to the resistor 3 in series so as to break the resistor 3 30–40 msec. after the main contact 2. On the other hand, at the time of making the circuit, it is necessary to make the resistor contact 7 via the resistor 3 about 10 msec. before the main contact 2 so as to minimize the overvoltage, and then to make the main contact 2, as in the case of the aforementioned resistor-provided 500,000-volt breaker.

As described above, the resistor-provided million-volt breaker must perform such a very complicated operation that at the time of making the circuit, the resistor contact 7 must be made about 10 msec. before the main contact 2, and, at the time of breaking the circuit, be opened 30–40 msec. after the contact 2. To achieve the complicated operation of the resistor contact 7, the structure shown in FIG. 2 may be employed. The operation mechanism unit 5 is used to operate both the main contact 2 and the resistor contact 7. A delaying mechanism unit 8 is provided for delaying and advancing the making and breaking of the resistor contact 7, performed by means of the operation mechanism unit 5, respectively.

It is necessary to design the resistor-provided breaker shown in FIG. 2 with a sufficient allowance, since the erroneous operation of making the resistor contact 7, after the main contact 2, or of breaking the resistor contact 7, before the main contact 2, may damage not only the breaker itself but also the overall system employing the breaker as the result of the occurrence of a great overvoltage. However, elongating, in accordance with an increase in the allowance, the time period during which the current flow is continued increases the load on the resistor 3. As a result, the resistor 3 must be made large. To avoid this, it is desirable to design each structural element to have an appropriate allowance, so that it can have an appropriate size. However, if the range of variations in the delay time period, set at the time of making and breaking the main contact 2 and the resistor contact 7, is wide, the design allowance for each structural element must be increased.

Thus, it is important to accurately control the resistor contact 7 such that it is made and broke before and after the main contact 2, respectively (such control will be hereinafter called "UHV operation control"). For example: simplifying the structure of the operation mechanism can enhance the operation accuracy, since the more the structure of the operation mechanism is simplified, the more its reliability is enhanced. Consider here the structure shown in FIG. 2, wherein the making and breaking of the resistor contact 7 is performed by means of the operation mechanism unit 5 which also makes and breaks the main contact 2, with the timing of the breaking and making of the contact 7 being adjusted by the delaying mechanism unit 8. In this case, however, the delaying mechanism unit 8 has a complicated function for advancing and delaying application of a driving force from the mechanism 5 to the resistor contact 7. This function makes complicated the overall operation mechanism including the delaying and operation mechanism units 5 and 8, and makes it difficult to enhance the reliability of the mechanism by merely simplifying the structure.

Then, consider another structure which employs an operation mechanism unit dedicated to making and breaking the resistor contact 7 and an operation mechanism unit dedicated to making and breaking the main contact 2. If the aforementioned UHV operation control is performed with the use of these two operation mechanisms, it is possible that the overall operation mechanism not only has a complicated structure, but also performs inaccurate operations. This is because the UHV operation control is very hard to perform when grounding noise or the like is mixed into an instruction signal for causing the resistor contact 7 to make before and break after the main contact 2.

SUMMARY OF THE INVENTION

It is the object of the invention to provide a resistor-provided UHV breaker of a simple structure capable of achieving the UHV operation control with high accuracy, and applicable to a UHV electric plant such as a substation in a million-volt power supply system line.

To attain the object, there is provided a resistor-provided UHV breaker comprising a tank sealing an insulating gas therein; a main contact unit located in the tank; a resistor unit connected parallel to the main contact unit; a resistor contact unit located in the tank, main contact making/breaking means for making and breaking the main contact unit; resistor contact making/-breaking means for making and breaking the resistor contact unit; and coupling means for coupling the main contact making/breaking means with the resistor contact making/breaking means, the coupling means driving the main contact making/breaking means together with the resistor contact making/breaking means during making operation of the main contact unit, and driving the main contact making/breaking means and the resistor contact making/breaking means, independently, during breaking operation of the main contact unit.

According to another aspect of the invention, there is a resistor-provided UHV breaker comprising: a tank sealing an insulating gas therein; a main contact unit located in the tank, and to be made and broke; a resistor unit located in the tank and connected parallel to the main contact unit; a resistor contact unit located in the tank and interposed between the main contact unit and the resistor unit, the resistor contact unit being made and broke; a main contact link mechanism located in the tank for making and breaking the main contact unit; a main contact operation mechanism located outside the tank for supplying the main contact link mechanism with a driving force to make and break the main contact unit; a resistor contact link mechanism located in the tank for making and breaking the resistor contact unit; a resistor contact operation mechanism located outside the tank for supplying the resistor contact link mechanism with a driving force to make and break the resistor contact unit; a coupling mechanism having an end coupled with the main contact link mechanism and the other end coupled with the resistor contact link mechanism, for coupling the main contact link mechanism with the resistor contact link mechanism, the coupling mechanism driving the main contact link mechanism together with the resistor contact link mechanism during making operation of the main contact unit, while driving the main contact link mechanism and the resistor contact link mechanism, independently, during breaking operation of the main contact unit;

a delaying mechanism for starting to open the resistor contact unit at a predetermined delay time after the main contact unit is broke; and an advancing mechanism for starting to make the resistor contact unit at a predetermined precedent time before the main contact unit is made.

In the invention constructed as above, the main contacts can reliably be prevented from making before the resistor contacts, as a result of engagement of the coupling mechanisms. Further, the resistor contacts can reliably be prevented from breaking before the main contacts. In addition, by virtue of the delaying mechanism, the resistor contact operation mechanism can start its making operation at a predetermined delay time after the main contacts are broke, with the result that the resistor contacts can break where the current flowing therethrough is zero current.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 6A, 6B, and 6C are cross sectional views of a coupling unit appearing in FIG. 3, taken in a plane perpendicular to its axis, wherein FIG. 6A shows an breaking state, FIG. 6B a making state, and FIG. 6C a state assumed from when main contacts have started to open and to when resistor contacts have started to open;

DETAILED DESCRIPTION OF THE PREFERRED EMBODIMENTS

Figure 1:
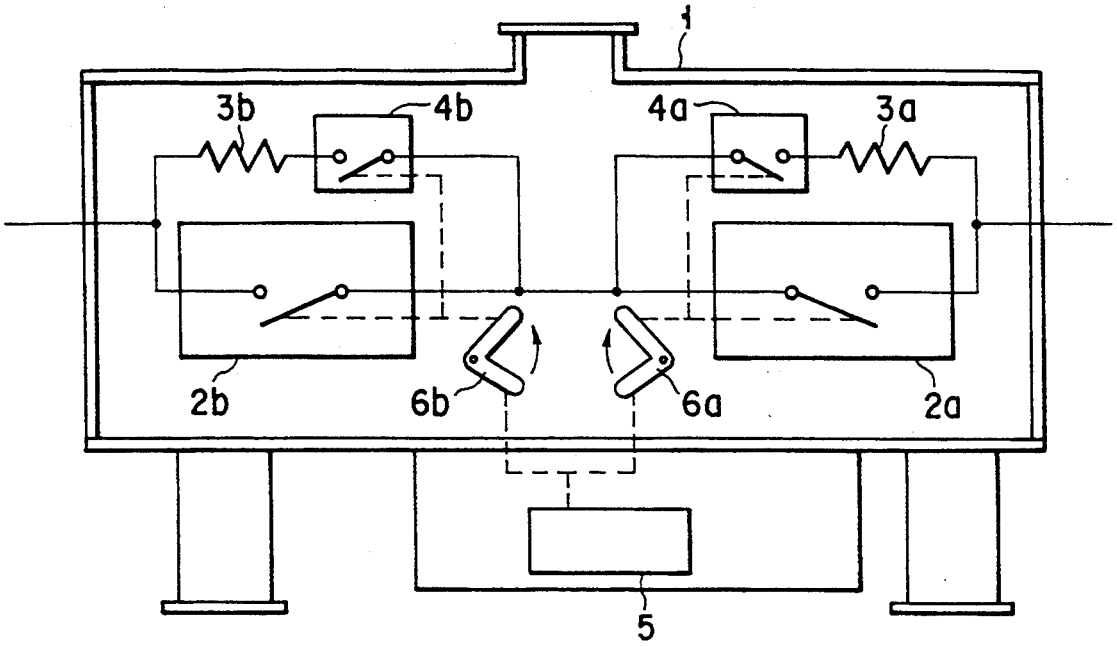
FIG. 1 PRIOR ART
FIG. 1 is a diagram, showing an example of a conventional resistor-provided 500,000-volt breaker.
Figure 2:
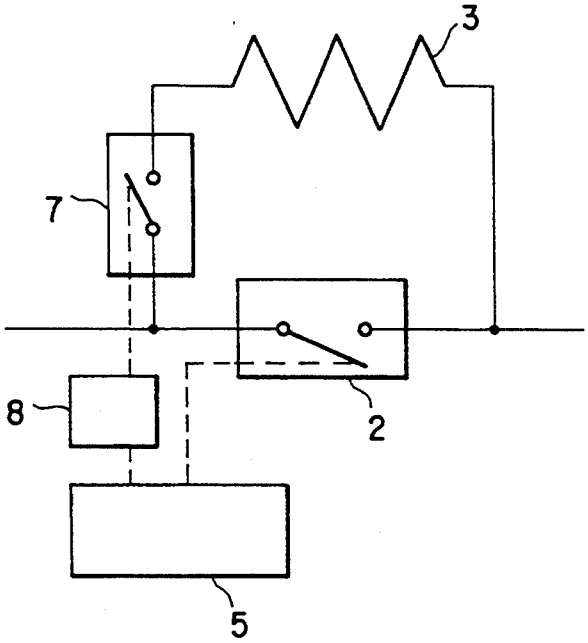
FIG. 2 PRIOR ART
FIG. 2 is a diagram, useful in explaining an example of a conventional resistor-provided breaker in which a resistor is made and broke.
Figure 3:
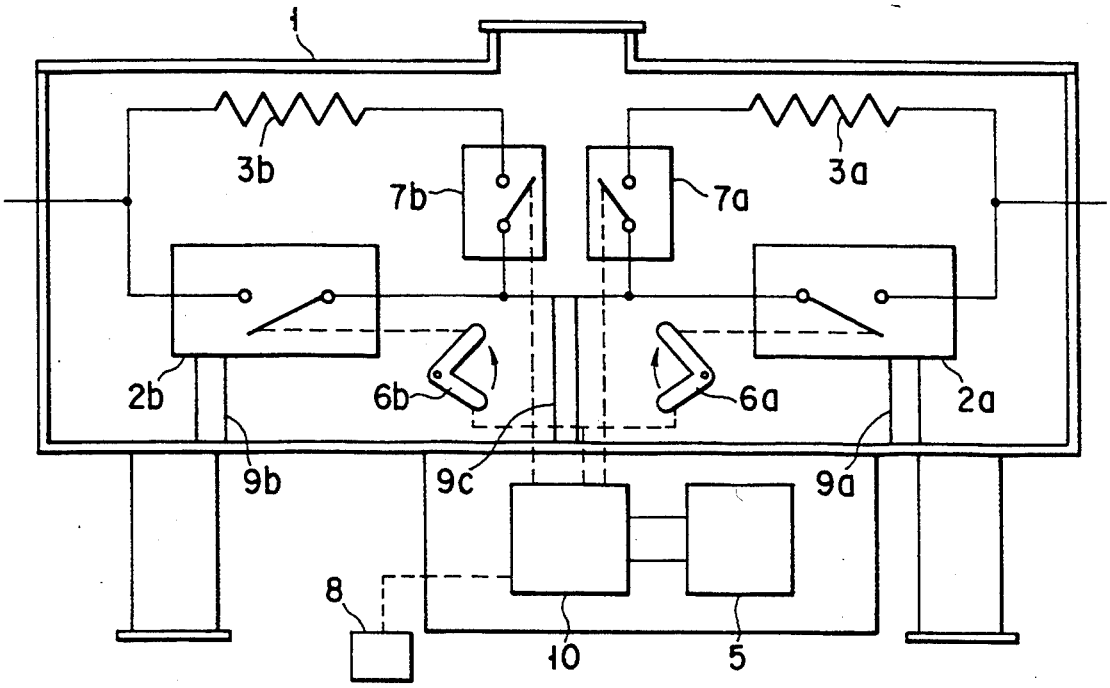
FIG. 3 is a diagram, showing a resistor-provided UHV breaker according to an embodiment of the invention.

A resistor-provided UHV breaker according to an embodiment of the invention will now be explained with reference to FIGS. 3–7. As is shown in FIG. 3, two main contacts 2*a* and 2*b* are received in a tank 1 in an axial direction thereof. In general, the tank 1 is located such that its axis (the line of the longitudinal direction) is parallel with the installation surface (ground). Therefore, there are many cases in which the axis of the tank 1 is in the horizontal direction. Two resistor contacts 7*a* and 7*b* are located in a central portion of the tank 1 in a direction perpendicular to the axis of the tank 1. The main contacts 2*a* and 2*b* are insulated from the tank 1 by means of insulators 9*a* and 9*b*, respectively. The resistor contacts 7*a* and 7*b* are insulated from the tank 1 by means of an insulator 9*c*. The inner terminals of the main contacts 2*a* and 2*b* are connected to the lower terminals of the resistor contacts 7*a* and 7*b*.

Resistors 3*a* and 3*b* are provided above the main contacts 2*a* and 2*b*, respectively. The inner ends of the resistors 3*a* and 3*b* are connected to the upper terminals of the resistor contacts 7*a* and 7*b*, respectively. The outer ends of the resistors 3*a* and 3*b* are connected to the outer terminals of the main contacts 2*a* and 2*b*, respectively. Further, a link mechanism unit 10 and a hydraulic operation mechanism unit 5 are located in a lower portion of the tank 1, and disposed to drive rotary links 6*a* and 6*b*.

Each of the resistor contacts 7*a* and 7*b* employs a known wipe mechanism using a spring and a floating contact element, so as to impart a wire difference between it and a corresponding one of the main contacts 2*a* and 2*b*. The wipe difference obtained by means of the wipe mechanism determines a precedent time point, at which the resistor contacts 7*a* and 7*b* start to be made after the main contacts 2*a* and 2*b* are made. Here, the precedent time period PT from when the resistor contacts are made to when the main contacts are made is set to about 10 msec.

Figures 4A, 4B:
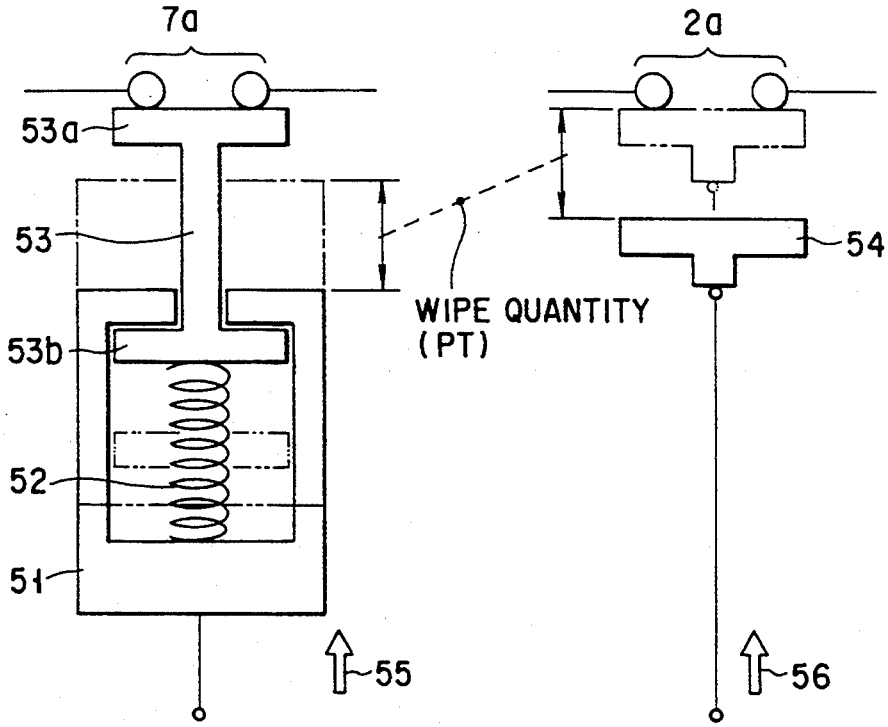
FIGS. 4A and 4B show an example of a wipe mechanism.

An example of the wipe mechanism will be explained with reference to FIGS. 4A and 4B. As is shown in FIG. 4A, a spring 25 is located in a wipe cylinder 51. A wipe piston 53 is incorporated in the wipe cylinder 51. The wipe piston has a contact-side plate (movable contact element) 53*a* opposed to the resistor contact 7*a*, and a cylinder-side plate 53*b* urged by the spring 52 in the cylinder 51. As is shown in FIG. 4B, a movable contact element 54 faces the main contact 2*a*. Continuously moving the cylinder 51 by an operation mechanism (not shown) in a direction indicated by the arrow 55 brings the contact-side plate (movable contact element) 53*a* of the piston 53 into contact with the resistor contact 7*a*, thereby making the resistor contact 7*a*. If the movable contact element 54 is urged in synchronism with the movement of the wipe cylinder 51 by an operation mechanism (not shown) in a direction indicated by the arrow 56, the contact element 54 does not contact the main contact 2*a* when the contact-side plate 53*a* of the piston 53 is in contact with the resistor contact 7*a*. Further moving the wipe cylinder 51 against the urging force of the spring 52 in the direction indicated by the arrow 55 causes the cylinder 51 to reach a position indicated by the broken line in FIG. 4A, with the contact-side plate kept in contact with the resistor contact 7*a*. At this time, the movable contact element 54 contacts the main contact 2*a*. The wipe quantity is that quantity of movement of the wipe cylinder 51 and the movable contact element 54, which is obtained from the start of making of the resistor contact 7*a* to the start of making of the main contact 2*a*. In other words, the wipe quantity corresponds to the precedent time period PT from the start of making of the resistor contacts 7*a* and 7*b* to the start of making of the main contacts 2*a* and 2*b*.

Figure 5:
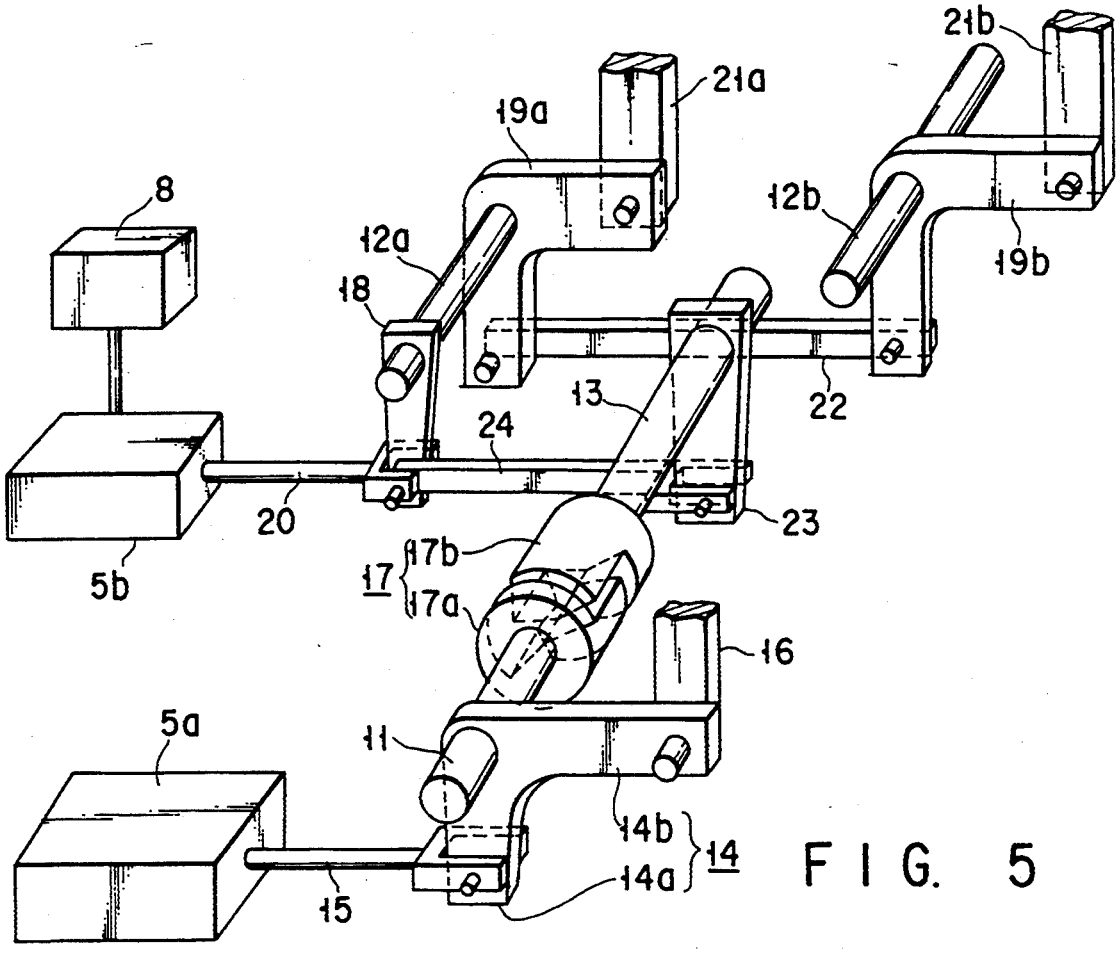
FIG. 5 is a perspective view, showing a link mechanism unit employed in the breaker shown in FIG. 3.

Then, the link mechanism unit shown in FIG. 3 will be described with reference to FIG. 5. As is shown in FIG. 5, the link mechanism unit 10 contains a main contact lever shaft 11, resistor contact lever shafts 12*a* and 12*b*, and a coupling lever shaft 13. An end of the main contact lever shaft 11 is opposed to an end of the coupling lever shaft 13. When these ends of the shafts 11 and 13 are engaged with each other, the shafts 11 and 13 are coupled with each other, thereby forming a rotary shaft. When the ends are disengaged, the shafts 11 and 13 are separated from each other, which means that the shafts 11 and 13 are mechanically isolated.

An L-shaped main contact operation lever 14 has a mechanism-side arm 14*a*, a contact-side arm 14*b*, and a bent portion fixed to the main contact lever shaft 11. The end of the mechanism-side arm 14*a* of the main contact operation lever 14 is coupled with a main contact operation bar 15, which is coupled with a main contact hydraulic operation mechanism 5*a*. The contact-side arm 14*b* of the lever 14 is provided with a main contact auxiliary link 16, which is coupled with the main contacts 2*a* and 2*b* via the rotary links 6*a* and 6*b*, respectively. A first coupling 17*a* having a cutout portion is provided at the end of the main contact lever shaft 11 opposed to the coupling lever shaft 13.

The resistor contact lever shaft 12*a* is attached to a resistor contact operation lever 18 and a resistor contact-side lever 19*a*, while the resistor contact lever shaft 12*b* is attached to a resistor contact-side lever 19*b*. The resistor contact operation lever 18 has a tip portion coupled with a resistor contact operation bar 20, which is coupled with a resistor contact hydraulic operation mechanism 5*b*. The resistor contact-side levers 19*a* and 19*b* are provided with resistor contact auxiliary links 21a and 21*b*, respectively. The links 21*a* and 21*b* are coupled with resistor contacts 8*a* and 8*b* via the rotary links 6*a* and 6*b*. The resistor contact lever shafts 12*a* and 12*b* are coupled with each other by means of a resistor contact coupling link 22.

The coupling lever shaft 13 is fixed to a coupling lever 23, which is coupled with both the resistor contact operation lever 18 and the resistor contact operation bar 20 via the coupling link 24. The end of the coupling lever shaft 13 opposed to the main contact lever shaft 11 is provided with a second coupling 17*b*, which has a cutout portion and can be engaged with the first coupling 17*a* by an urging force. The first and second couplings 17*a* and 17*b* form first and second sector cam members, respectively.

Figure 6A:
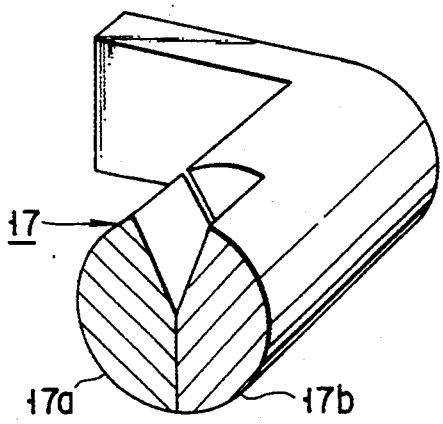
Figure 6B:
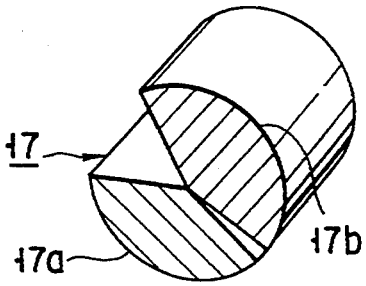
Figure 6C:
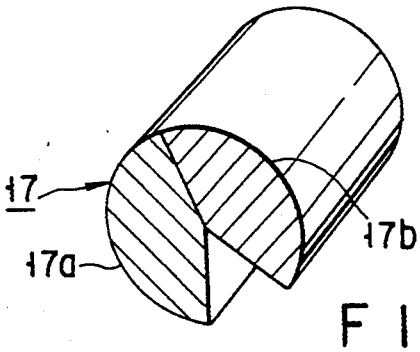

FIGS. 6A, 6B, and 6C are cross sectional views of a coupling unit 17 employed in the embodiment, taken in a plane perpendicular to its axis, wherein FIG. 6A shows an breaking state, FIG. 6B a making state, and FIG. 6C a state assumed from when the main contacts start to break to when the resistor contacts start to make. As is shown in FIG. 6A, the first and second couplings 17*a* and 17*b* have sector-shaped cross sections of substantially the same circular arc, and a sector-shaped cutout portion of a small central angle is interposed therebetween when one side of the sector-shaped cross section of the coupling 17*a* contacts one side of that of the other coupling 17*b*. At the time of making operation of the contacts, in accordance with rotation of the main contact lever shaft 11 in a predetermined direction, the first coupling 17*a* rotates in the same direction as the shaft 11, thereby urging the second coupling 17*b* and rotating the coupling lever shaft 13 in the same direction as the shaft 11. On the other hand, at the time of opening operation of the contacts, the main contact lever shaft 11 rotated in a direction reverse to the above, thereby disengaging the first coupling 17*a* from the second coupling 17*b* and allowing them to rotate independently.

The resistor contact hydraulic operation mechanism 5*b* is also coupled to a known delaying mechanism unit 8. The unit 8 controls the resistor contact hydraulic operation mechanism 5*b* to open the resistor contacts 7*a* and 7*b* at a predetermined delay time point after the main contacts 2*a* and 2*b* are broke by the main contact hydraulic operation mechanism 5*a*. The delay time period DT from the start of breaking of the main contacts 2*a* and 2*b* to the start of breaking of the resistor contacts 7*a* and 7*b* is set to 30–40 msec. In general, the delaying mechanism 8 can have a structure which utilizes a pressure difference between the main contact hydraulic operation mechanism 5*a* and the resistor contact hydraulic operation mechanism 5*b*. There is no problem, of course, if the delaying mechanism unit 8 has a structure which does not utilize the pressure difference.

The operation of the embodiment constructed as above will be explained with reference to FIGS. 6A, 6B, 6C, and 7.

Figure 7:
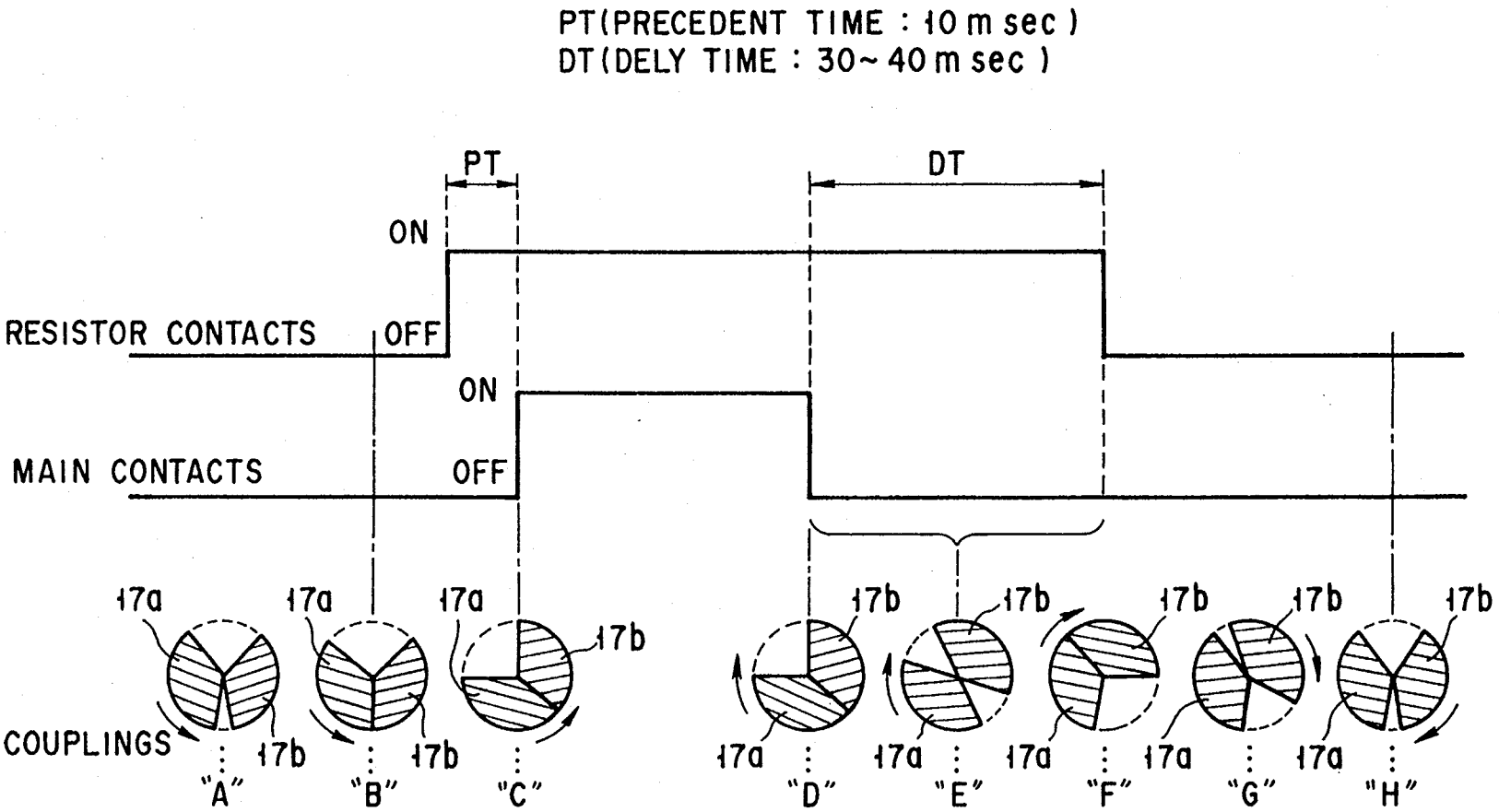
FIG. 7 is a view, showing the relationship between the states of main contacts and resistor contacts and changes in the coupling unit obtained with lapse of time.

First, in a breaking state where the coupling unit 17 has the state shown in FIG. 6A or "A" and "B" of FIG. 7, the main contacts 2*a* and 2*b* and the resistor contacts 7*a* and 7*b* are open. In this state, when an instruction indicative of closing has been input to the main contact hydraulic operation mechanism 5*a* and to the resistor contact hydraulic operation mechanism 5*b*, the mechanisms 5*a*, 5*b* drive the main contact operation lever 14 and the resistor contact operation lever 18 via the main contact operation shaft 15 and the resistor contact operation shaft 20, respectively.

At this time, as is shown in "B" and "C" of FIG. 7, the first coupling 17*a* provided on the main contact lever shaft 11 rotates counterclockwise while urging the second coupling 17*b* provided on the coupling lever shaft 13.

As described above, where the first couplings 17*a* exists in a rotating direction of second coupling 176, the main contact operation lever 14 and the coupling lever 23 can be rotated simultaneously, as shown "B" and "C" in FIG. 7, by setting the rotational speed of the main contact lever shaft 11 faster than that of the coupling lever shaft 13. Accordingly, the resistor contact operation lever 18 and the resistor contact-side levers 19*a* and 19*b*, which are coupled with the coupling lever 23, can be rotated simultaneously. As a result, the main contacts 2*a* and 2*b* can reliably be prevented from making at a precedent time before the resistor contacts 7*a* and 7*b* are made, and be simultaneously made. As explained above, since a wipe mechanism is employed in each of the resistor contacts 7*a* and 7*b*, the wipe quantity difference enables the contacts 7*a* and 7*b* to be made at a precedent time before the main contacts are made, and hence the breaker is connected to the outside circuit via the resistors 3*a* and 3*b*, thereby minimizing the overvoltage. The main contacts 2*a* and 2*b* are made about 10 msec. after the resistor contacts 7*a* and 7*b*, thereby bypassing the resistors 3*a* and 3*b*. In this state, the couplings 17*a* and 17*b* of the coupling unit 17 have the relationship shown in FIG. 6B and "C" and "D" in FIG. 7.

Then, when an opening instruction has been input to the main contact hydraulic operation mechanism 5*a* and to the delaying mechanism unit 8, the mechanism 5*a* drives the main contact operation lever 14 via the main contact operation shaft 15 ("D" and "E" in FIG. 7). At this time, the operation of the resistor contact hydraulic operation mechanism 5*b* is prevented by the mechanism unit 8, and hence does not start its contact-breaking operation. Thus, as is shown in "E" and "F" in FIG. 7, only the main contact-side mechanism starts contact-breaking operation, and the first coupling 17*a* on the main contact lever shaft 11 rotates clockwise so as to be separated from the second coupling 17*b*. Since at this time the second coupling 17*b* prevented by the delaying mechanism unit 8 from supplying its driving force, and stopped. In this case when second coupling 176 is rotated by erroneous operation at clockwise, second coupling 176 exists in the rotating direction of first coupling 17*a*, the second coupling 17*b* cannot rotate before the first coupling 17*a*. Accordingly, the resistor contacts 7*a* and 7*b* can reliably be prevented from opening before the main contacts 2*a* and 2*b*. In other words, only the main contacts 2*a* and 2*b* can be broke by the main contact operation lever 14 as shown in "D" and "E" in FIG. 7, where the current flowing therethrough is 0.

As a result, current flows through the resistors 3*a* and 3*b* and the resistor contacts 7*a* and 7*b*. Where only the main contacts 2*a* and 2*b* are break, the couplings 17*a* and 17*b* of the coupling unit 17 have the relationship shown in FIG. 6C. In other words, the surfaces of the couplings 17*a* and 17*b* opposite to those contacting in the made state of the main contacts 2*a* and 2*b* are in contact with each other.

Where only the main contacts 2*a* and 2*b* are open as shown in FIG. 6C and "F" in FIG. 7, the second coupling 17*b* is released from the first coupling 17*a* in a clockwise direction (breaking direction), and hence independently rotatable. In other words, the resistor contact hydraulic operation mechanism 5*b* starts, as a result of the control of the delaying mechanism unit 8, its breaking operation 30–40 msec. after the main contacts 2*a* and 2*b* have been opened. Thus, the resistor contact operation lever 18 is driven via the resistor contact operation shaft 20 ("G" in FIG. 7), thereby breaking the resistor contacts 7*a* and 7*b* where the current flowing therethrough is 0 ("H" in FIG. 7).

As explained above, in the embodiment, the main contacts 2*a* and 2*b* can be operated independent from the resistor contacts 7*a* and 7*b* by the use of the two hydraulic operation mechanisms 5*a* and 5*b* and the one delaying mechanism unit 8. At the time of making the circuit, the resistor contacts 7*a* and 7*b* are closed about 10 msec. before the main contacts 2*a* and 2*b*, whereas at the time of breaking the circuit the resistor contacts 7*a* and 7*b* are broke 30–40 msec. before the main contacts 2*a* and 2*b*.

In addition, since the main contacts 2*a* and 2*b* can be simultaneously driven in a reliable manner by the first coupling 17*a* provided on the main contact lever shaft 11 and the second coupling 17*b* provided on the coupling lever shaft 13, the resistor contacts 7*a* and 7*b* can be made at all times before the contacts 2a and 2b, and the range of variations in precedent time period is small. On the other hand, at the time of breaking operation, the resistor contact lever shafts 12a and 12b are fixed by the coupling lever shaft 13, and the coupling lever shaft 13 is prevented by the coupling unit 17 from rotating before the main contact lever shaft 11. Thus, the resistor contacts 7a and 7b can reliably be prevented from breaking before the main contacts 2a and 2b, and the range of variations in president time period is small, thereby enhancing the reliability of the breaker.

Figure 8:
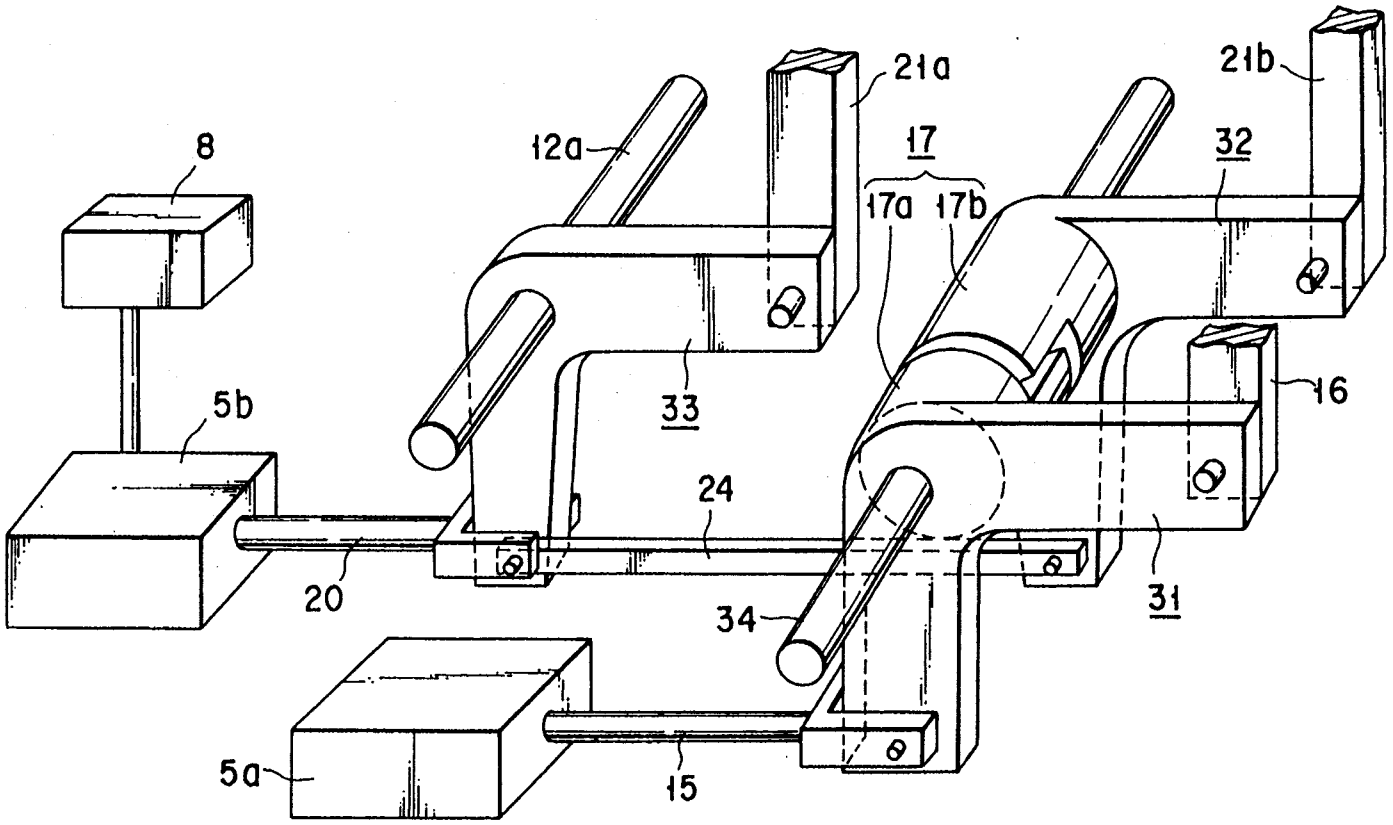
FIG. 8 is a perspective view, showing a link mechanism unit employed in a resistor-provided UHV breaker according to another embodiment of the invention.

Then, another embodiment of the invention will be explained with reference to FIG. 8. This embodiment differs from the embodiment shown in FIGS. 3–7 as follows:

A main contact operation lever 31 obtained by forming integral as one body the main contact operation 14 and the first coupling 17a is employed. A coupling lever 32 is formed integral with the second coupling 17b into one body, which body has also the function of the resistor contact-side lever 19b. The resistor contact operation lever 18 and the resistor contact-side lever 19a are formed integral into a resistor contact operation lever 33.

By virtue of the above structure, the overall mechanism can have a simple structure. Further, since the levers 31 and 32 are rotatably attached to a single shaft 34, the amount of misalignment of the axes of the levers 31 and 32 can be minimized.

As described above, by virtue of a simple structure in which there are provided a main contact operation mechanism and a resistor contact operation mechanism coupled with first and second levers, respectively, and a coupling unit is provided between the first and second levers, resistor contacts which are required to perform complicated operations can be accurately driven by means of the operation mechanisms of simple structures and high reliability, thereby imparting the breaker with an appropriate allowance and enhancing the safety thereof.

In summary, according to the invention, the UHV control can be performed accurately without a complicated structure, and hence a resistor-provided UHV breaker can be provided which is applicable to a UHV plant such as a substation in a million-volt power supply system line.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A resistor-provided UHV breaker comprising:

a tank sealing an insulating gas therein a main contact unit located in the tank and consisting of a pair of main contacts to be made and broke;

a resistor unit located in the tank and connected parallel to the main contact unit;

a resistor contact unit located in the tank and interposed between the main contact unit and the resistor unit, the resistor contact unit consisting of a pair of resistor contacts being made and broke;

a main contact link mechanism located in the tank for making and breaking the main contacts;

a main contact operation mechanism located outside the tank for supplying the main contact link mechanism with a driving force to make and break the main contacts;

a resistor contact link mechanism located in the tank for making and breaking the resistor contacts;

a resistor contact operation mechanism located outside the tank for supplying the resistor contact link mechanism with a driving force to make and break the resistor contacts; and a coupling mechanism having one end coupled with the main contact link mechanism and another end coupled with the resistor contact link mechanism, for coupling the main contact link mechanism with the resistor contact link mechanism, the coupling mechanism driving the main contact link mechanism together with the resistor contact link mechanism during making operation of the main contacts, while driving the main contact link mechanism and the resistor contact link mechanism, independently, during breaking operation of the main contacts.

2. The resistor provided UHV breaker according to claim 1, wherein the coupling mechanism has a first coupling consisting of a cam mechanism fixed to the rotary shaft of the main contact link mechanism;

a second coupling consisting of a cam mechanism fixed to the rotary shaft of the resistor contact link mechanism; and means for selectively engaging the first and second couplings with each other and disengaging them from each other in synchronism with the operations of the main contact and resistor contact link mechanisms.

3. The resistor-provided UHV breaker according to claim 1, further comprising a delaying mechanism for starting to break the resistor contacts at a predetermined delay time after the main contacts is broke, and an advancing mechanism for starting to make the resistor contacts at a predetermined precedent time before the main contacts is made.

4. A resistor-provided UHV breaker comprising:

a tank sealing an insulating gas therein a main contact unit located in the tank and consisting of a pair of main contacts to be made and broke;

a resistor unit located in the tank and connected parallel to the main contact unit, respectively;

a resistor contact unit located in the tank and interposed between the main contact unit and the resistor unit, the contact unit consisting of a pair of resistor contacts being made and broke;

a main contact link mechanism located in the tank for supplying the main contact link mechanism with a driving force to make and break the main contacts;

a resistor contact link mechanism located in the tank for making and breaking the resistor contacts;

a resistor contact operation mechanism located outside the tank for supplying the resistor contact link mechanism with a driving force to make and break the resistor contacts;

a coupling mechanism having one end coupled with the main contact link mechanism and another end coupled with the resistor contact link mechanism, for coupling the main contact link mechanism with the resistor contact link mechanism, the coupling mechanism driving the main contact link mechanism together with the resistor contact link mechanism during making operation of the main contacts, while driving the main contact link mechanism and the resistor contact link mechanism, independently, during breaking operation of the main contacts;

a delaying mechanism for starting to break the resistor contacts at a predetermined delay time after the main contacts are broke; and an advancing mechanism for starting to make the resistor contacts at a predetermined precedent time before the main contacts is made.

5. The resistor-provided UHV breaker according to claim 4, wherein the main contact link mechanism has a rotary shaft to be rotated by the driving force generated by the main contact operation mechanism, the rotary shaft making and breaking the main contacts via the coupling mechanism when rotating;

the resistor contact link mechanism has a rotary shaft to be rotated by the driving force generated by the resistor contact operation mechanism, the rotary shaft making and breaking the resistor contacts via the coupling mechanism when rotating; and the coupling mechanism has a first coupling consisting of a cam mechanism fixed to the rotary shaft of the main contact link mechanism; a second coupling consisting of a cam mechanism fixed to the rotary shaft of the resistor contact link mechanism; and means for selectively engaging the first and second couplings with each other and disengaging them from each other in synchronism with the operations of the main contact and resistor contact link mechanisms.

6. The resistor-provided UHV breaker according to claim 5, wherein the cam mechanism of the first coupling has a rotatable first sector cam member, and the cam mechanism of the second coupling has a rotatable second sector cam member to be engaged with and disengaged from the first sector cam member.

* * * * *